US008251709B2

(12) United States Patent
Kuo

(10) Patent No.: US 8,251,709 B2
(45) Date of Patent: Aug. 28, 2012

(54) ELECTRICAL CONNECTOR WITH IMPROVED CABLE FIXATION

(75) Inventor: Peter Kuo, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/964,724

(22) Filed: Dec. 9, 2010

(65) Prior Publication Data

US 2011/0143558 A1 Jun. 16, 2011

(30) Foreign Application Priority Data

Dec. 10, 2009 (TW) ..... 98223132 U

(51) Int. Cl.
*H01R 12/70* (2006.01)

(52) U.S. Cl. ..... 439/55

(58) Field of Classification Search ..... 439/55, 439/660, 637, 497, 499, 417, 351, 492
See application file for complete search history.

(56) References Cited

U.S. PATENT DOCUMENTS

| | | | | |
|---|---|---|---|---|
| 6,095,856 | A * | 8/2000 | Horan et al. | 439/567 |
| 7,914,322 | B2 * | 3/2011 | Lin | 439/497 |
| 2008/0188136 | A1 * | 8/2008 | Su et al. | 439/660 |
| 2009/0130878 | A1 * | 5/2009 | Xu et al. | 439/157 |
| 2009/0275244 | A1 * | 11/2009 | Chen et al. | 439/676 |

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector includes a housing including a mating portion located in the front portion thereof, a plurality of contacts received in the housing and each including a tail extending out of the rear wall of the housing, a cover assembled on the housing, and a plurality of cables. The mating portion of the housing defines a mating direction and a rear wall. The cables each includes an inner conductor electrically connected to the tail of the contact, an inner insulation layer, an shielding braids and an outer insulation layer. The rear wall includes a plurality of ribs every two of which form a receiving slot therebetween and a plurality of protrusions every two of which form a fastening slot therebetween. The ribs and the protrusions respectively extend in two rows along a horizontal direction perpendicular to the mating direction and form a groove therebetween. The outer insulation layers of the cables are fastened in the receiving slots and the inner insulation layers are fastened in the fastening slots.

20 Claims, 5 Drawing Sheets

ELECTRICAL CONNECTOR WITH IMPROVED CABLE FIXATION

BACKGROUND OF THE INVENTION

1. Field of the Invention

The present invention relates generally to an electrical connector, and more particularly to an electrical connector used in electric device and having improved cable fixation.

2. Description of the Prior Art

Serial Advanced Technology Attachment (SATA) connectors are widely used in electric device such as notebooks. A SATA connector always comprises a housing, a plurality of conducts received in the housing, and a cover assembled on the rear portion of the housing. And the SATA connector is always assembled on a board through inserting a plurality of post formed on the SATA connector into a plurality of holes formed on the board. However, when the bottom wall of SATA connector is too large, the SATA connector can not be assembled on the board through above method. On the other hand, cables are free in present SATA connector, which easily brings on wrong connecting between the cables and contacts.

Hence, in this art, an improved electrical connector to overcome the above-mentioned disadvantages of the prior art should be provided.

BRIEF SUMMARY OF THE INVENTION

A primary object, therefore, of the present invention is to provide an electrical connector with an improved structure for fixing cables.

In order to implement the above object, the electrical connector comprises a housing comprising a mating portion located in the front portion thereof, a plurality of contacts received in the housing and each comprising a tail extending out of the rear wall of the housing, a cover assembled on the housing, and a plurality of cables. The mating portion of the housing defines a mating direction and a rear wall. The cables each comprises an inner conductor electrically connected to the tail of the contact, an inner insulation layer, an shielding braids and an outer insulation layer. The rear wall comprises a plurality of ribs every two of which form a receiving slot therebetween and a plurality of protrusions every two of which form a fastening slot therebetween. The ribs and the protrusions respectively extend in two rows along a horizontal direction perpendicular to the mating direction and form a groove therebetween. The outer insulation layers of the cables are fastened in the receiving slots and the inner insulation layers are fastened in the fastening slots.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
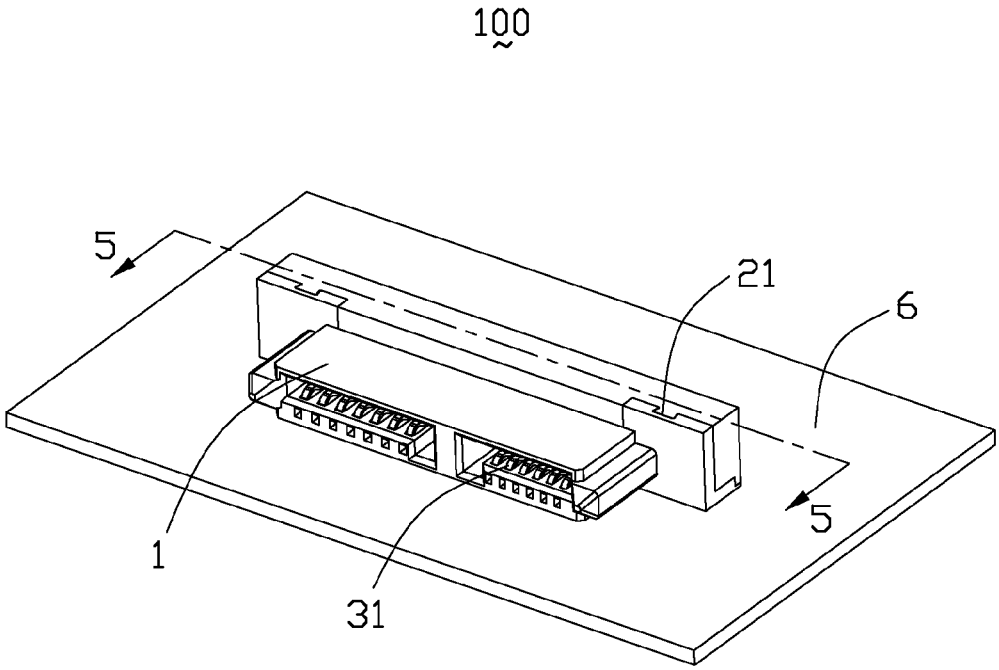
FIG. 1 is a perspective view of an electrical connector assembly in according with the present invention.
Figure 2:
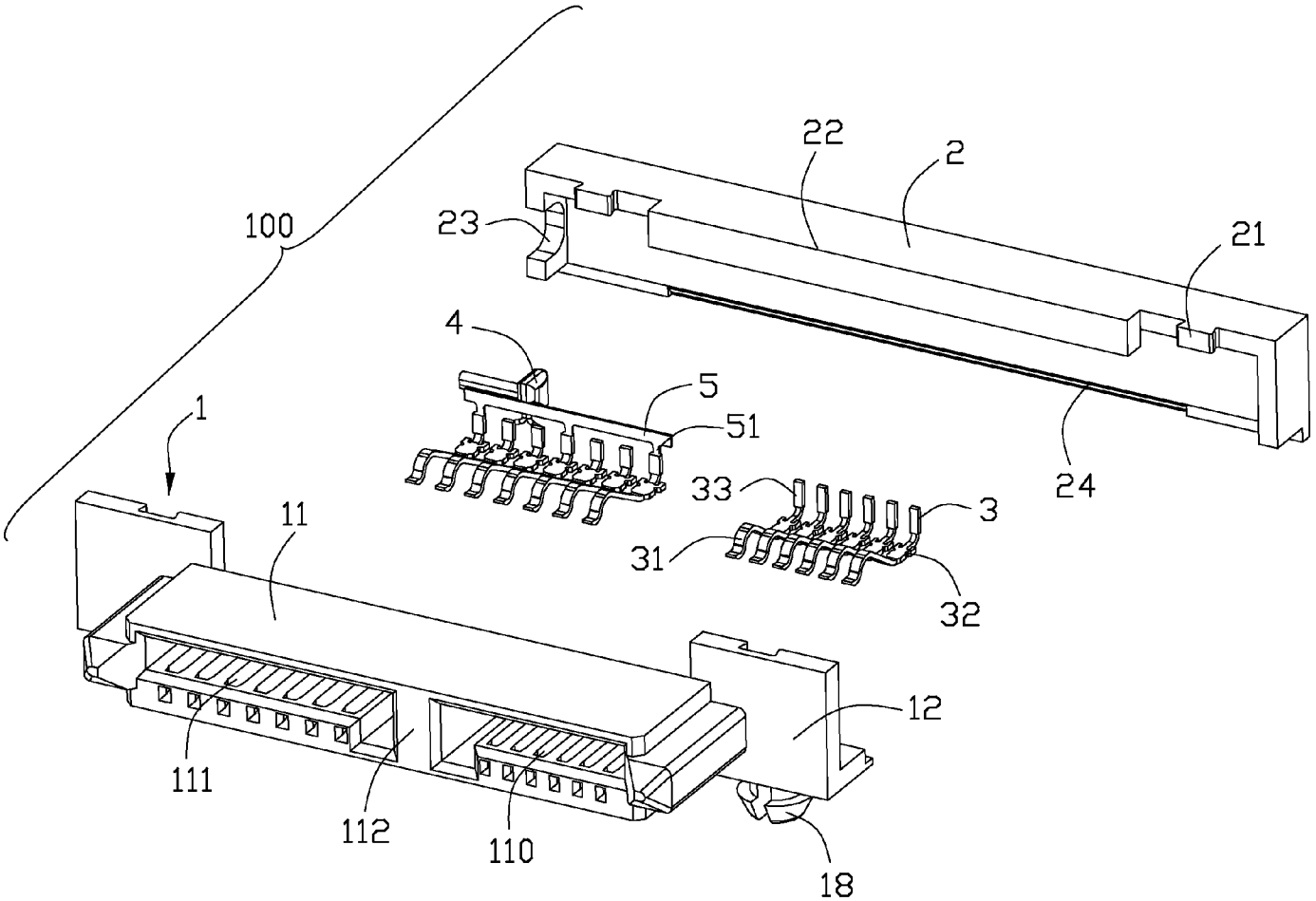
FIG. 2 is an exploded, perspective view of the electrical connector assembly in according with the present invention.
Figure 3:
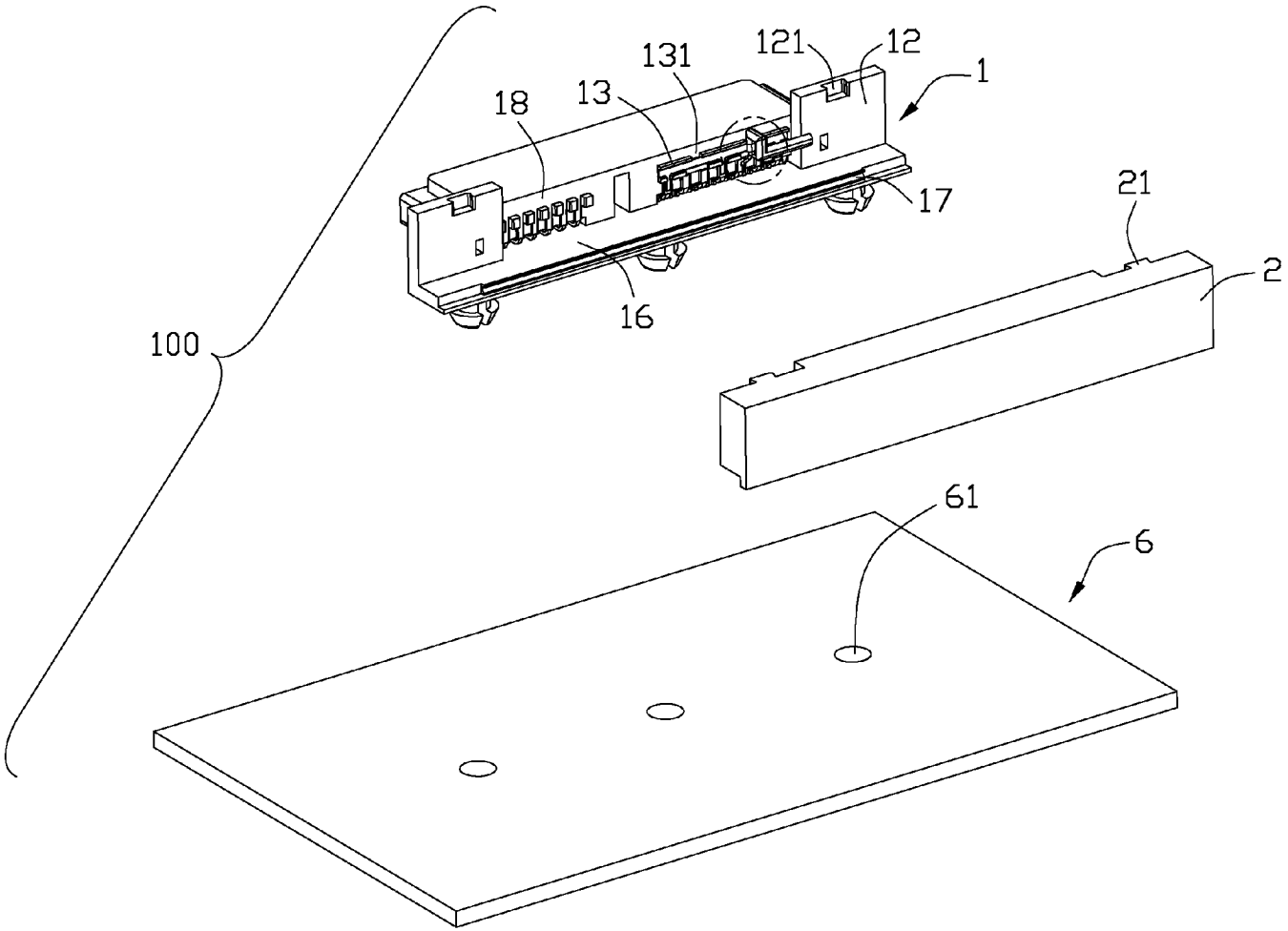
FIG. 3 is an assembled perspective view of part components of the electrical connector assembly of the present invention.
Figure 4:
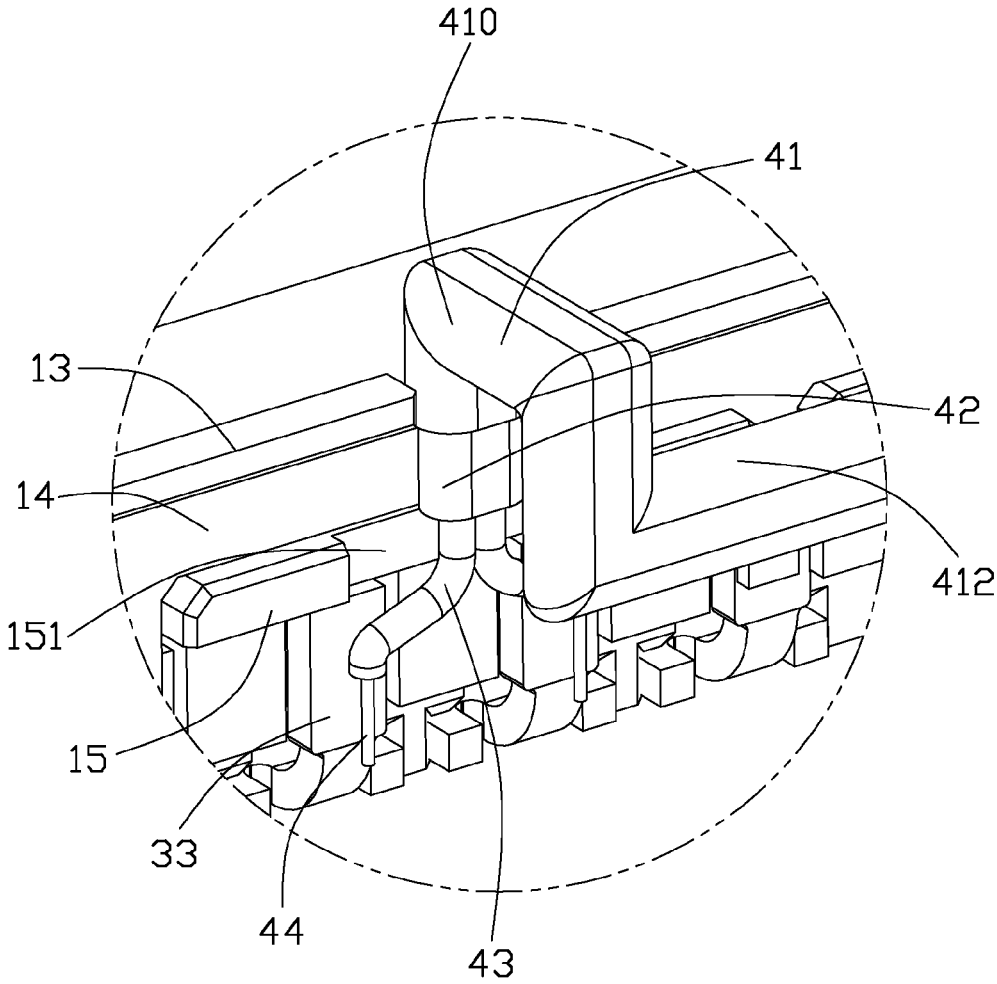
FIG. 4 is a partly extended view of FIG. 3.
Figure 5:
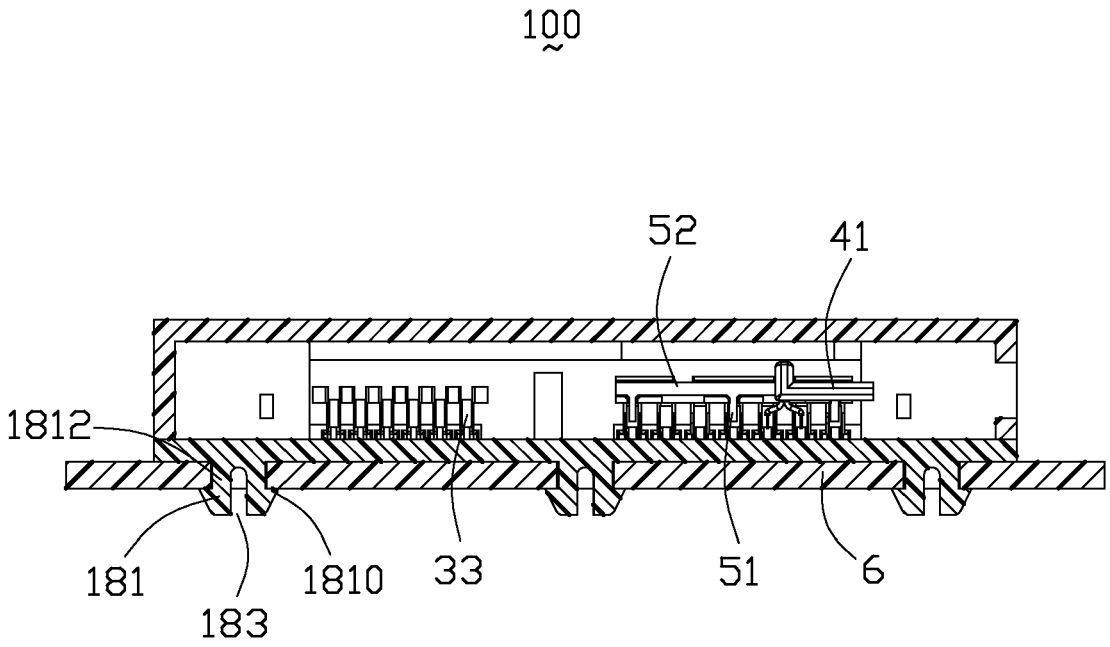
FIG. 5 is a cross-section view of the electrical connector assembly taken along line 5-5 of FIG. 1.

Reference to FIGS. 1 to 5, an electrical connector assembly 100 in according with a preferred embodiment of the present invention is shown. The electrical connector assembly 100 comprises a housing 1, a plurality of contacts 3 received in the housing 1, a cover 2 assembled on the housing from rear to front, a plurality of cables 4 connected to the contacts 3, a grounding bar 5 received in the housing 1, and a board 6 assembled with the housing 1 from low to up.

The housing 1 comprises a mating portion 11 located in the front portion thereof and defining a mating direction and a rear wall 113, a base portion 16 rearward extending from the rear wall, and a pair of wing portions 12 extending from the rear wall to the side and located on the base portion 16. The mating portion 11 comprises a plurality of receiving troughs 110, 111. The receiving troughs 110, 111 pass through the mating portion 11 and the rear wall 113 and are divided by a spacer 112.

The wing portion 12 is substantially rectangular and has a front wall connected to the rear wall of mating portion 11. The receiving trough 110, 111 are arranged between the two wing portions 12. Each of the wing portions 12 comprises a swallow-tailed slot 121 connected to the top surface and the rear surface of the wing portion 12. The swallow-tailed slot 121 has a wider front portion and a narrower rear portion.

The rear wall 113 of mating portion 11 comprises a plurality of ribs 13 extending along a horizontal direction perpendicular to the mating direction and a plurality of protrusions 15 located below the ribs 13. Every two of the ribs 13 form a receiving slot 131 therebetween, and the protrusions 15 form a plurality of graduated length fastening slot 151 therebetween. The receiving slots 131 are corresponding to the fastening slots 151, and each pair of receiving slot 131 and the fastening slot 151 is arranged in a line along a vertical direction perpendicular to the mating direction. The ribs 13 and the protrusions 15 respectively extend in two rows along a horizontal direction perpendicular to the mating direction and form a groove 14 therebetween. The grounding bar 5 is received in the groove 14. The protrusions 15 are located above the receiving troughs 110, 111.

The base portion 16 comprises a lip portion 17 located on the rear edge thereof and a plurality of fastening portion 18 formed on a lower surface thereof. Each of the fastening portions 18 is formed by a pair of semicircular poles 181 with a slot 183 therebetween. Each semicircular pole 181 has a larger head 1810 and a smaller staff 1812 connecting the head 1810 to the base portion 18. The board 6 comprises a plurality of holes 61 corresponding to the fastening portions 18, and the fastening portions 18 pass through their corresponding holes 61 with the heads 1810 exposed out of the board 6 and the staff 1812 received in the holes 61.

The cover 2 comprises a top wall and a rear wall downward extending from the top wall. There is no bottom wall in the cover. A projection 22 is formed in the middle of the top wall of the cover 2 and downward extends from the top wall of the cover 2 for attaching the rear portion of the top wall of the housing 1. A pair of swallow-tailed protrusions 21, which are corresponding to the swallow-tailed slots 121 of the housing 1, are respectively located on the two sides of the projection 22 and frontward extends form the top wall of the cover 2. When the cover 2 is assembled on the housing 1, the swallow-tailed protrusions 22 are inserted into the swallow-tailed slots 121 along an up-to-down direction for the cover 2 firmly assembled on the housing 1 along a front-to-rear direction.

are A fastening rib 24 is formed on the bottom of the rear wall of the cover 2 for mating to the lip portion 17 of the housing 1. A hole 23 is formed on one side of the cover 2.

The cables 4 are coaxial cables and each comprises an inner conductor 44 electrically connected to the tail 33 of the contact 3, an inner insulation layer 43 received in the longer fastening slots 151, an shielding braids 42 connected to the grounding bar 5 and an outer insulation layer 41. The outer insulation layer 41 comprises a U-shaped end 410 fastened in the receiving slots 131 and an extending portion 412 extending along a direction parallel to the ribs 13 of the housing 1 to pass through the hole 23 of the cover 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a housing comprising a mating portion located in the front portion thereof and defining a mating direction and a rear wall;

a plurality of contacts received in the housing and each comprising a tail extending out of the rear wall of the housing;

a cover assembled on the housing;

a plurality of cables each comprising an inner conductor electrically connected to the tail of the contact, an inner insulation layer, an shielding braid and an outer insulation layer; wherein the rear wall comprises a plurality of ribs every two of which form a receiving slot therebetween and a plurality of protrusions every two of which form a fastening slot therebetween, the ribs and the protrusions respectively extend in two rows along a horizontal direction perpendicular to the mating direction and form a groove therebetween, the outer insulation layers of the cables are fastened in the receiving slots and the inner insulation layers are fastened in the fastening slots.

2. The electrical connector as claimed in claim 1, further comprising a grounding bar electrically connected to the shielding braids of the cables, the grounding bar being received in the groove of the rear wall of the housing.

3. The electrical connector as claimed in claim 1, wherein the receiving slots, the groove, the fastening slots and the tails of the contacts are arranged from up to down, and the inner conductors, the inner insulation layers, the shielding braids and the outer insulation layers are arranged from down to up.

4. The electrical connector as claimed in claim 3, wherein the outer insulation layer comprises a U-shaped end fastened in the receiving slots and an extending portion extending along a direction parallel to the ribs of the housing.

5. The electrical connector as claimed in claim 1, wherein the housing further comprises a pair of wing portions, each of the wing portions has a swallow-tailed slot, the cover has a pair of swallow-tailed protrusions corresponding to the swallow-tailed slots.

6. The electrical connector as claimed in claim 5, wherein the swallow-tailed slot is connected to a top surface and rear wall of the housing and has a wider front portion and a narrower rear portion.

7. The electrical connector as claimed in claim 1, wherein the housing further comprises a base portion rearward extending from the rear wall thereof, the base portion has a plurality of fastening portion formed on a lower surface thereof.

8. The electrical connector as claimed in claim 7, wherein the fastening portion is formed by a pair of semicircular poles with a slot therebetween.

9. An electrical connector assembly, comprising:

a housing comprising a mating portion a mating portion located in the front portion thereof and defining a mating direction and a rear wall, and a base portion rearward extending from the rear wall;

a plurality of contacts received in the housing and each comprising a tail extending out of the rear wall of the housing;

a cover assembled on the housing;

a plurality of cables each comprising an inner conductor electrically connected to the tail of the contact, an inner insulation layer, an shielding braids and an outer insulation layer; and a board assembled with the base portion; wherein the base portion comprises a plurality of fastening portions formed on a lower surface thereof, each of the fastening portions is formed by a pair of semicircular poles with a slot therebetween, the board has a plurality of holes corresponding to the fastening portions, the rear wall comprises a plurality of ribs every two of which form a receiving slot therebetween and a plurality of protrusions every two of which form a fastening slot therebetween, the ribs and the protrusions respectively extend in two rows along a horizontal direction perpendicular to the mating direction and form a groove therebetween, the outer insulation layers of the cables are fastened in the receiving slots and the inner insulation layers are fastened in the fastening slots.

10. The electrical connector as claimed in claim 9, further comprising a grounding bar electrically connected to the shielding braids of the cables, the grounding bar being received in the groove of the rear wall of the housing.

11. The electrical connector as claimed in claim 9, wherein the receiving slots, the groove, the fastening slots and the tails of the contacts are arranged from up to down, and the inner conductors, the inner insulation layers, the shielding braids and the outer insulation layers are arranged from down to up.

12. The electrical connector as claimed in claim 11, wherein the outer insulation layer comprises a U-shaped end fastened in the receiving slots and an extending portion extending along a direction parallel to the ribs of the housing.

13. The electrical connector as claimed in claim 9, wherein the housing further comprises a pair of wing portions, each of the wing portions has a swallow-tailed slot, the cover has a pair of swallow-tailed protrusions corresponding to the swallow-tailed slots.

14. The electrical connector as claimed in claim 13, wherein the swallow-tailed slot is connected to a top surface and rear wall of the housing and has a wider front portion and a narrower rear portion.

15. An electrical connector comprising:

an insulative housing defining a forwardly extending mating portion, a base portion extending rearwardly from a rear face of the housing under condition that said rear face is perpendicular to a mating direction of the mating portion, and a pair of wing portions located around two opposite ends of the mating portion in a lengthwise direction perpendicular to said mating direction and upon the base portion in a vertical direction perpendicular to both said mating direction and said lengthwise direction;

a plurality of contacts disposed in the housing with contacting sections exposed into the mating portion and soldering sections on the rear face in a parallel relation;

a grounding bar connected to the corresponding contacts and extending in a plane located behind and parallel to the rear face of the housing, and a cable including at least a pair of wires respectively mechanically and electrically connected to the soldering sections of the corresponding contacts, respectively, and shielding braids surrounding the wires and mechanically and electrically connected to the grounding bar.

16. The electrical connector as claimed in claim 15, wherein said cable forms a plurality of bends around the soldering sections and the grounding bar under condition that said plurality of bends defining a upside-down U-shaped configuration extend in a plane perpendicular to said rear face of the housing.

17. The electrical connector as claimed in claim 15, wherein said cable defines behind the rear face a long segment extending from one end of the U-shaped configuration in the lengthwise direction.

18. The electrical connector as claimed in claim 15, further including a cover attached to the rear face of the housing to cooperate with the housing for sandwiching the cable therebetween in said mating direction, wherein the housing and the cover define corresponding slots and protrusions to allow the cover to be assembled to the housing only in the vertical direction.

19. The electrical connector as claimed in claim 15, wherein the rear face of the housing defines at least one vertical slot to receive the cable therein.

20. The electrical connector as claimed in claim 15, wherein said ground bar is unitarily linked with more than one corresponding contacts.

* * * * *